US010807374B2

(12) United States Patent
Namba

(10) Patent No.: US 10,807,374 B2
(45) Date of Patent: Oct. 20, 2020

(54) LIQUID JETTING APPARATUS

(71) Applicant: Brother Kogyo Kabushiki Kaisha, Nagoya-shi, Aichi-ken (JP)

(72) Inventor: Mamoru Namba, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/145,056

(22) Filed: Sep. 27, 2018

(65) Prior Publication Data

US 2019/0092026 A1 Mar. 28, 2019

(30) Foreign Application Priority Data

Sep. 28, 2017 (JP) ..... 2017-187640

(51) Int. Cl.

| | |
|---|---|
| ***B41J 2/17*** | (2006.01) |
| ***B41J 2/175*** | (2006.01) |
| ***B41J 29/38*** | (2006.01) |
| ***B41J 29/13*** | (2006.01) |

(52) U.S. Cl.

CPC ..... *B41J 2/1721* (2013.01); *B41J 2/1752* (2013.01); *B41J 2/17513* (2013.01); *B41J 2/17523* (2013.01); *B41J 2/17553* (2013.01); *B41J 2/17566* (2013.01); *B41J 29/13* (2013.01); *B41J 29/38* (2013.01)

(58) Field of Classification Search

CPC ..... B41J 2/17503; B41J 2/17566; B41J 2/17593; B41J 2/17596; B41J 2/17563; B41J 2/18; B41J 2/1721; B41J 29/13; B41J 2/1752; B41J 2/17513; B41J 2/17553; B41J 2/17523

See application file for complete search history.

(56) References Cited

FOREIGN PATENT DOCUMENTS

| | | |
|---|---|---|
| JP | 2006-082294 A | 3/2006 |
| JP | 2010-132006 A | 6/2010 |

*Primary Examiner* — Kristal Feggins

(74) *Attorney, Agent, or Firm* — Banner & Witcoff, Ltd.

(57) ABSTRACT

A liquid jetting apparatus includes: a case including a bottom which supports, from below, a liquid tank containing a liquid, and side parts which stand upright from the bottom and face side surfaces of the liquid tank; a first absorbing member disposed outside the case to extend along the bottom of the case and configured to absorb the liquid; and a second absorbing member disposed outside the case to extend along one of the side parts of the case while being brought into contact with the first absorbing member, and having an absorption ratio of the liquid which is higher than that of the first absorbing member under a non-pressurization state. The first absorbing member includes a groove which extends to the second absorbing member to guide the liquid leaking downward from the liquid tank to the second absorbing member.

8 Claims, 9 Drawing Sheets

LIQUID JETTING APPARATUS

CROSS REFERENCE TO RELATED APPLICATION

The present application claims priority from Japanese Patent Application No. 2017-187640 filed on Sep. 28, 2017, the disclosure of which is incorporated herein by reference in its entirety.

BACKGROUND

Field of the Invention

The present invention relates to a liquid jetting apparatus including a case that accommodates a liquid tank.

Description of the Related Art

Japanese Patent Application Laid-open No. 2010-132006 describes an ink-jet printer including: a holder case accommodating a cartridge; a slider provided on a bottom plate of the holder case to install the cartridge; a first ink absorber disposed in a space inside the slider; and a second ink absorber disposed on a lower side of the bottom plate of the holder case. The first ink absorber of the ink-jet printer has a contact piece that is brought in contact with the second ink absorber via a communication hole provided in the bottom plate of the holder case. In that configuration, the first ink absorber absorbs the ink that may leak from an insertion opening for the cartridge when the cartridge is removed from the slider, and the second ink absorber disposed below the first absorber absorbs, through the contact piece, the ink absorbed by the first ink absorber. That configuration inhibits the ink leakage to the outside of the printer.

SUMMARY

In the ink-jet printer as described in Japanese Patent Application Laid-open No. 2010-132006, every time a small amount of ink leaks from the insertion opening, for example, at the time of removal of the cartridge, the first ink absorber absorbs the small amount of ink and the second ink absorber absorbs the ink absorbed by the first ink absorber. This configuration, however, may not absorb the ink satisfactorily when a large amount of ink leaks at once from the cartridge having a large ink capacity. Namely, when a large amount of ink leaks from the cartridge, the ink can be partially absorbed by a part of the first ink absorber positioned in the vicinity of the insertion opening for the cartridge, but a remaining amount of leaking ink flows downward along the holder case, absorbed by the second ink absorber. In that case, since the first ink absorber absorbs only the small amount of the leaking ink, the second ink absorber has to absorb the remaining large amount of ink. This may cause a problem in which the remaining large amount of ink cannot be absorbed by the second ink absorber completely, resulting in the ink leakage to the outside of the printer.

An object of the present teaching is to provide a liquid jetting apparatus that is capable of preventing liquid in a liquid tank from leaking to the outside of the liquid jetting apparatus.

According to an aspect of the present teaching, there is provided a liquid jetting apparatus, including:

a case including a bottom which supports, from below, a liquid tank containing a liquid, and side parts which stand upright from the bottom and face side surfaces of the liquid tank, a first absorbing member disposed outside the case to extend along the bottom of the case and configured to absorb the liquid; and a second absorbing member disposed outside the case to extend along one of the side parts of the case while being brought into contact with the first absorbing member, and having an absorption ratio of the liquid which is higher than that of the first absorbing member under a non-pressurization state, wherein the first absorbing member includes a groove which extends to the second absorbing member to guide the liquid leaking downward from the liquid tank to the second absorbing member.

According to the aspect of the present teaching, when a relatively large amount of liquid leaks downward beyond the case from the liquid tank, the liquid is absorbed by the first absorbing member disposed below the case and guided to the second absorbing member by the groove. In that configuration, the liquid can be effectively absorbed not only by the first absorbing member but also by the second absorbing member having high absorption ability. This prevents the liquid from leaking to the outside of the apparatus. Further, since the second absorbing member is disposed to extend along one of the side parts of the case, the liquid jetting apparatus can be downsized.

DESCRIPTION OF THE EMBODIMENTS

In the following, a multifunction peripheral 1 including a printer unit is explained. The printer unit is an exemplary liquid jetting apparatus according to an embodiment of the present teaching. The multifunction peripheral 1 is used in a placement state depicted in FIG. 1. In this embodiment, an up-down direction A1, a front-rear direction A2, and a left-right direction A3 are defined as indicated by arrows in FIG. 1. FIGS. 2 to 9 use the three directions indicated in FIG. 1 as they are.

<Outline of Multifunction Peripheral 1>

Figure 1:
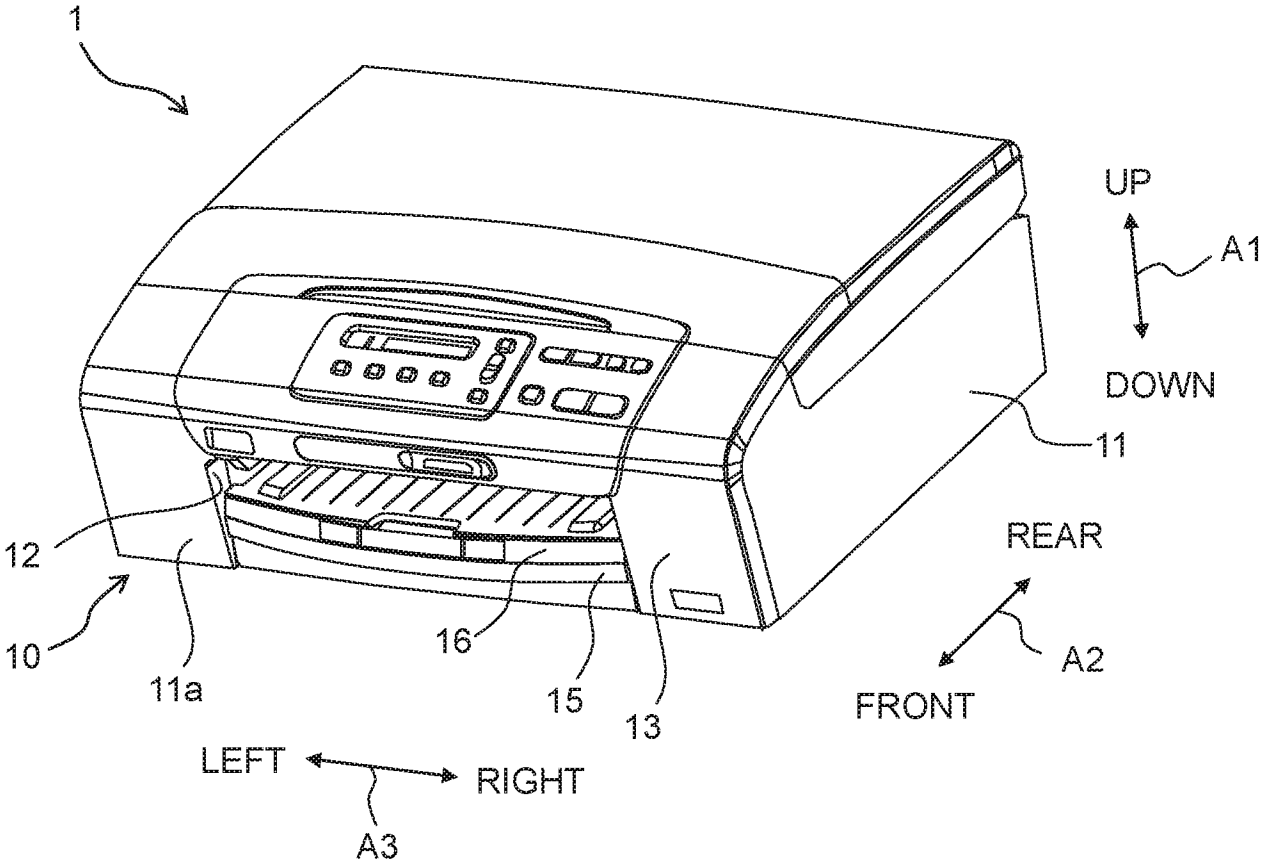
FIG. 1 is a perspective view of a multifunction peripheral.

As depicted in FIG. 1, the multifunction peripheral 1 has substantially a thin rectangular parallelepiped shape. A display and operation buttons are provided on an upper surface of the multifunction peripheral 1. The printer unit 10 is provided at a lower portion of the multifunction peripheral 1. The multifunction peripheral 1 has different types of functions, such as a scanner function and a printing function.

The printer unit 10 includes a casing 11. An opening 12 is provided at substantially a center portion of a front wall 11*a* of the casing 11. A feed tray 15 and a discharge tray 16 are provided in the up-down direction A1 such that the discharge tray 16 is disposed on an upper side of the feed tray 15. The feed tray 15 is insertable/removable with respect to the opening 12 in the front-rear direction A2, namely, the feed tray 15 is configured to be removable from the casing 11. A sheet P having a desired size is placed on the feed tray 15. The multifunction peripheral 1 is connectable to an external apparatus, such as a personal computer (hereinafter referred to as a PC). The multifunction peripheral 1 executes a recording operation based on a recording command from a scanner unit or the PC. Further, the multifunction peripheral 1 executes a variety of functions through an operation on the operation button(s) performed by a user.

Figure 5A:
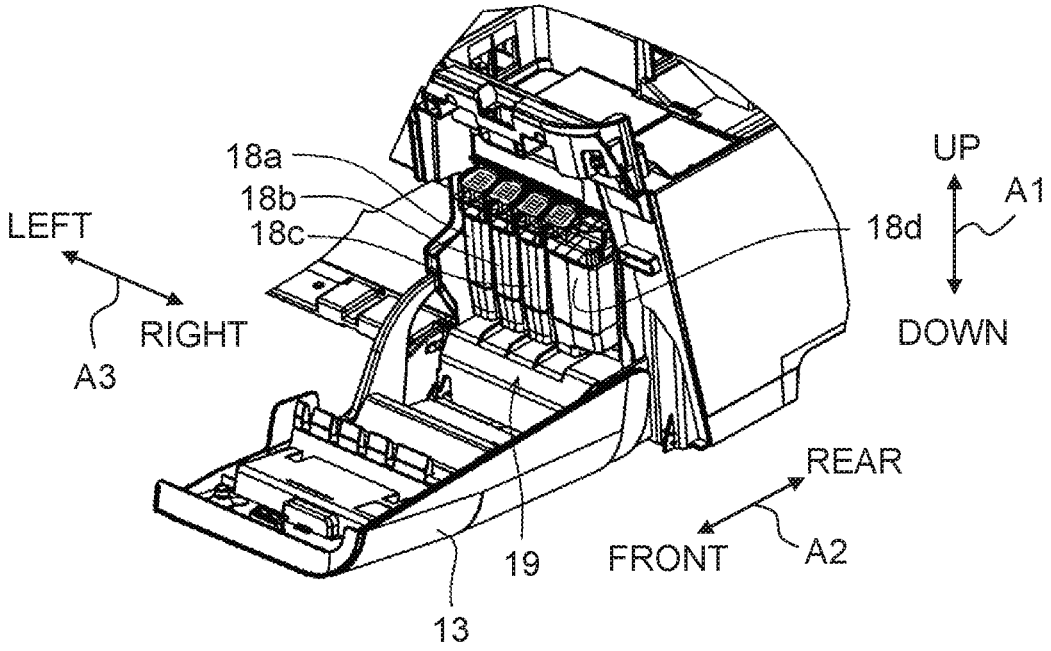
FIG. 5A is a perspective view of a main part of the multifunction peripheral, wherein an openable and closable cover depicted in FIG. 1 is open.
Figure 5B:
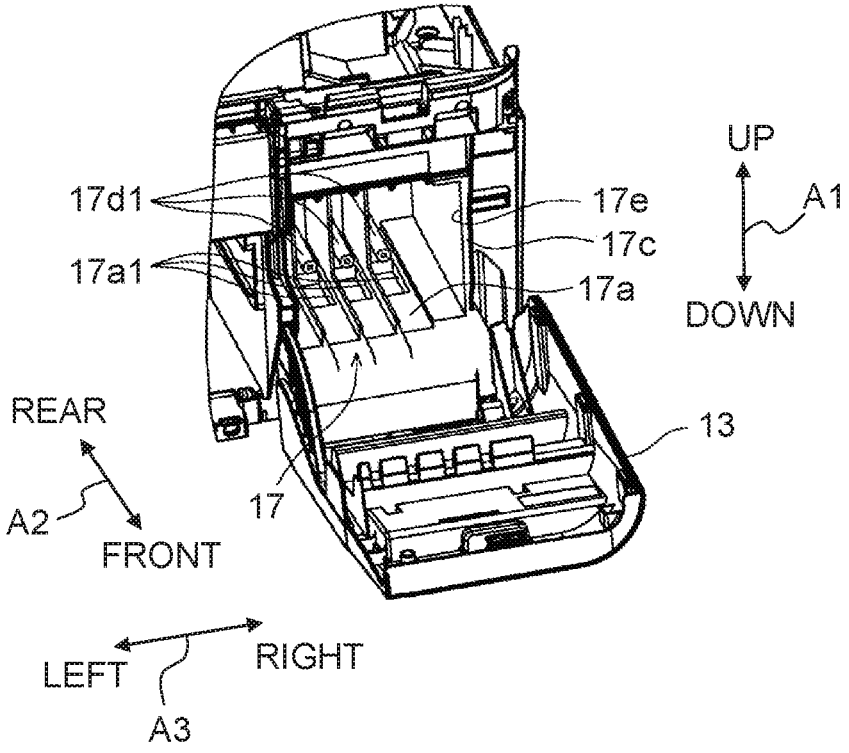
FIG. 5B is another perspective view of the main part of the multifunction peripheral, wherein four ink cartridges depicted in FIG. 5A are removed.

As depicted in FIG. 1, an openable and closable cover 13 (hereinafter simply referred to as a cover 13) is provided at a right portion of the front wall 11*a* of the casing 11. The cover 13 is configured to pivotally move with a pivot shaft disposed at its lower end and extending in the left-right direction A3 as a pivot center. The cover 13 in a closed state faces, in the front-rear direction A2, an ink unit 19 described below (see FIG. 3). As depicted in FIG. 5A, opening the cover 13 allows ink cartridges 18*a* to 18*d* of the ink unit 19 to be installed or removed with respect to a holder 17. FIG. 5B depicts a state in which the four ink cartridges 18*a* to 18*d* are removed from the holder 17. A direction toward a rear side in the front-rear direction A2 is an installation direction of the ink cartridges 18*a* to 18*d* with respect to the holder 17.

<Internal Structure of Printer Unit 10>

Figure 2:
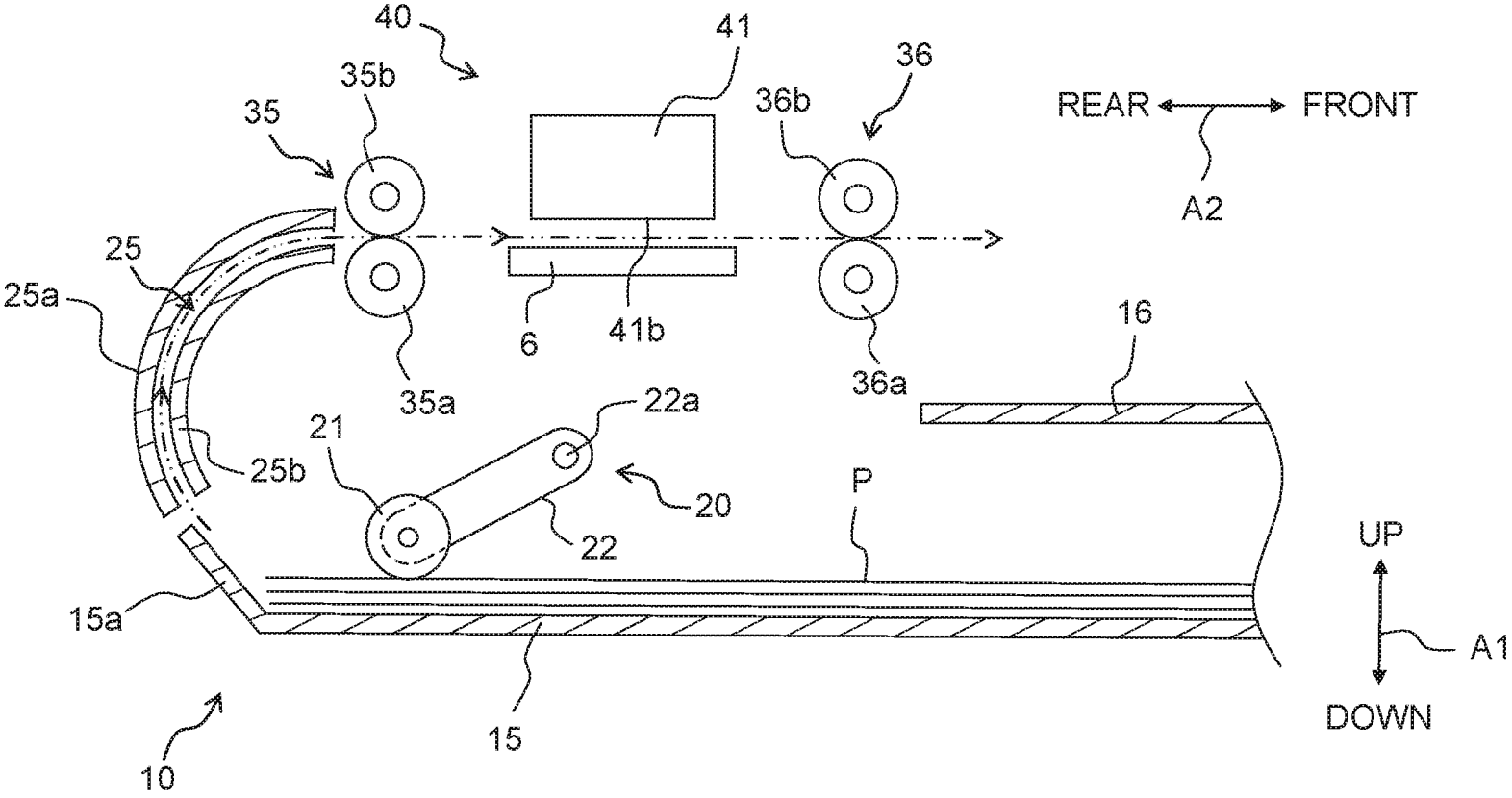
FIG. 2 is a schematic side view of an internal structure of a printer unit depicted in FIG. 1.
Figure 3:
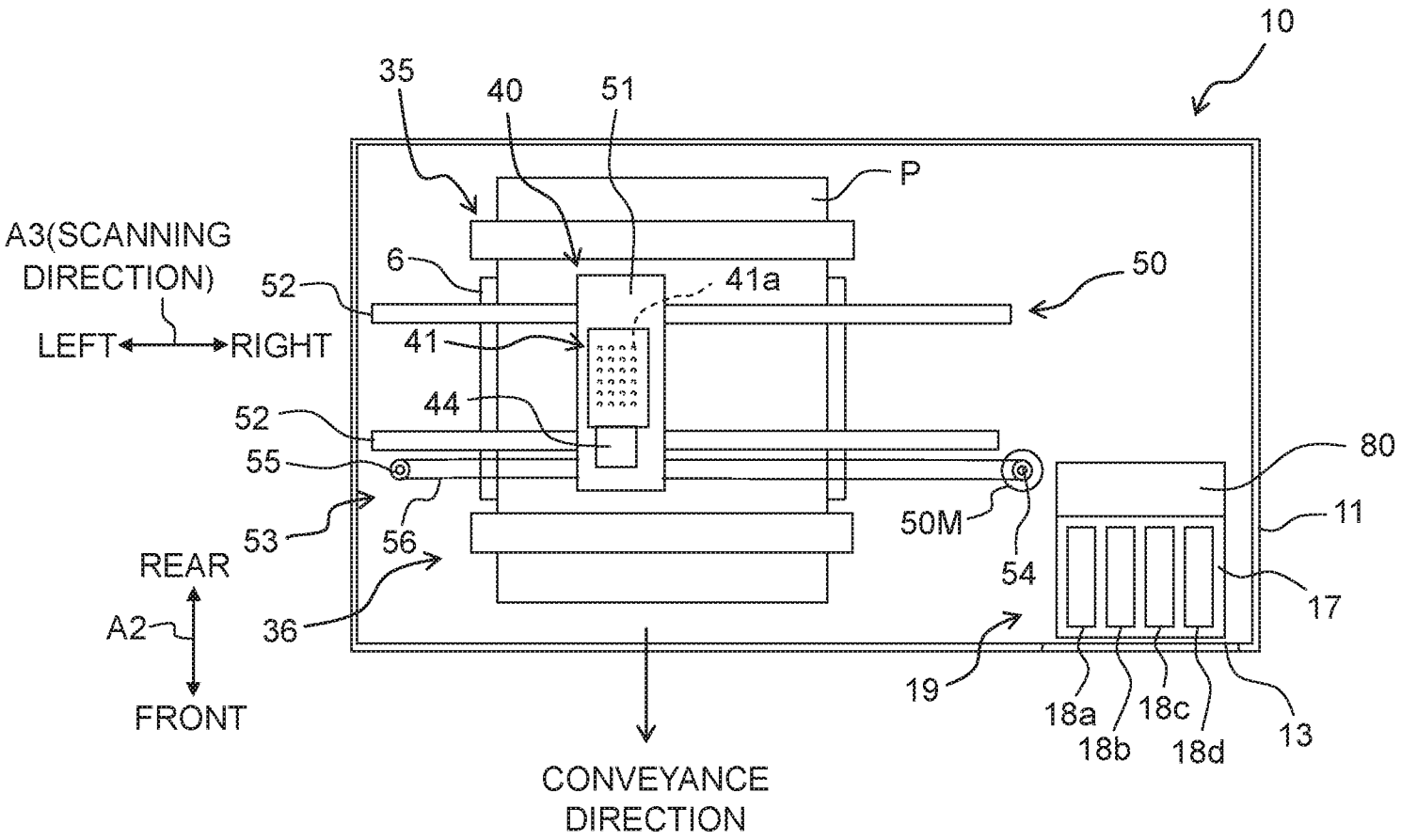
FIG. 3 is a schematic plan view of the printer unit depicted in FIG. 1.

Subsequently, an internal structure of the printer unit 10 is explained. As depicted in FIGS. 2 and 3, the printer unit 10 includes a feed unit 20, a conveyance roller pair 35, a recording unit 40, an ink unit 19, a discharge roller pair 36, an Auto Sheet Feed (ASF) motor 20M (see FIG. 4), a Line Feed (LF) motor 35M (see FIG. 4), and a controller 5 (see FIG. 4). The feed unit 20 feeds the sheet P placed on the feed tray 15 to a conveyance route 25. The conveyance roller pair 35 conveys the sheet P fed by the feed unit 20 to the recording unit 40. The recording unit 40, which is configured in accordance with, for example, an ink-jet recording system, records an image on the sheet P conveyed by the conveyance roller pair 35. The discharge roller pair 36 discharges the sheet P, for which recording has been performed by the recording unit 40, on the discharge tray 16. A conveyance mechanism conveying the sheet P is formed from the feed unit 20, the conveyance roller pair 35, and the discharge roller pair 36.

The ink unit 19 includes the holder 17 and the four ink cartridges 18*a* to 18*d*. As depicted in FIG. 3, the holder 17 is provided at a right front side of the casing 11. The four ink cartridges 18*a* to 18*d* respectively containing four colors of inks (black, yellow, cyan, and magenta) are removably installed in the holder 17.

<Feed Unit 20>

As depicted in FIG. 2, the feed unit 20 is provided on the upper side of the feed tray 15. The feed unit 20 includes a feed roller 21 and an arm 22. The feed roller 21 is pivotally supported by a front end of the arm 22. The arm 22 is pivotally supported by a support shaft 22*a*. Urging the arm 22 with a spring or the like causes the feed roller 21 to move downward so that the feed roller 21 comes into contact with the feed tray 15. The arm 22 can retract upward when the feed tray 15 is inserted or removed with respect to the casing 11. The feed roller 21 rotates when receiving power of the ASF motor 20M via a transmission mechanism (not depicted), feeding the sheet P loaded on the feed tray 15 to the conveyance route 25.

<Feed Tray 15>

As depicted in FIG. 2, the feed tray 15 includes an oblique wall 15*a*. The oblique wall 15*a* guides the sheet P to the conveyance route 25 when the sheet P placed on the feed tray 15 is fed by the feed roller 21.

<Conveyance Route 25>

As depicted in FIG. 2, the conveyance route 25 is formed from an outside guide member 25*a* and an inside guide member 25*b* facing each other at a predefined interval. The conveyance route 25 makes a U-turn while extending from a rear end of the feed tray 15 toward a front side of the printer unit 10. The sheet P fed from the feed tray 15 is guided through the conveyance route 25 from its lower side to its upper side to reach the recording unit 40.

<Conveyance Roller Pair 35 and Discharge Roller Pair 36>

The conveyance roller pair 35 includes a conveyance roller 35*a* and a pinch roller 35*b*. The conveyance roller 35*a* is disposed on a lower side of the pinch roller 35*b*. The conveyance roller 35*a* rotates when receiving power of the LF motor 35M via a transmission mechanism (not depicted). The pinch roller 35*b* rotates following the rotation of the conveyance roller 35*a*. The conveyance roller 35*a* and the pinch roller 35*b* cooperate to nip the sheet P in the up-down direction A1 and to convey the sheet P to the recording unit 40.

The discharge roller pair 36 includes a discharge roller 36*a* and a spur roller 36*b*. The discharge roller 36*a* is disposed on a lower side of the spur roller 36*b*. The discharge roller 36*a* rotates when receiving the power of the LF motor 35M via the transmission mechanism (not depicted). The spur roller 36*b* rotates following the rotation of the discharge roller 36*a*. The discharge roller 36*a* and the spur roller 36*b* cooperate to nip the sheet P in the up-down direction A1 and to convey the sheet P to the discharge tray 16.

<Recording Unit 40>

As depicted in FIGS. 2 and 3, the recording unit 40 includes a recording head 41, a head moving mechanism 50, and a platen 6. The head moving mechanism 50 includes a carriage 51. The carriage 51 reciprocates in a scanning direction (the left-right direction A3 orthogonal to a conveyance direction of the sheet P). The recording head 41 is supported by the carriage 51.

A lower surface of the recording head 41 is a jetting surface 41*b* having jetting ports 41*a* from which each of the inks is jetted to the sheet P conveyed below the recording head 41. As depicted in FIG. 3, the jetting ports 41*a* are aligned in the conveyance direction to form four jetting-port rows arranged in the scanning direction. In this embodiment, a black ink is jetted from the jetting ports 41*a* belonging to a rightmost jetting-port row, and color inks (magenta, cyan, and yellow inks) are jetted from the jetting ports 41*a* belonging to the remaining three jetting-port rows (see FIG. 3). The controller 5 controls the recording head 41 based on a recording command to jet each of the inks, as fine or minute ink droplets, from each jetting port 41*a*.

The recording head 41 is provided integrally with a tube joint 44. The recording head 41 is connected to the four ink cartridges 18*a* to 18*d* via flexible four tubes (not depicted)

connected to the tube joint 44 and ink channels (not depicted) in the holder 17, supplying the respective inks to the recording head 41.

The platen 6, which supports the sheet P conveyed by the conveyance roller pair 35 from below, is disposed below the recording head 41. The platen 6 is provided in a part, of a moving range of the carriage 51, through which the sheet P passes. The width of the platen 6 is considerably larger than a width of a sheet P having a largest size that can be conveyed, allowing the sheet P conveyed through the conveyance route 25 to pass through the platen 6 at all times.

As depicted in FIG. 3, the head moving mechanism 50 includes guide rails 52 and a belt transmission mechanism 53. The guide rails 52 are disposed to separate from each other in the front-rear direction A2 and extend parallel to each other in the left-right direction A3. The carriage 51 is disposed to extend beyond the guide rails 52 in the front-rear direction A2. The carriage 51 reciprocates along the guide rails 52 in the left-right direction A3.

The belt transmission mechanism 53 includes two pulleys 54 and 55, an endless timing belt 56 that is partially fixed to the carriage 51, and a carriage motor 50M. The two pulleys 54 and 55 are disposed to separate from each other in the left-right direction A3. The timing belt 56 is wound around the two pulleys 54 and 55. The pulley 54 is connected to a drive shaft of the carriage motor 50M. Driving the carriage motor 50M causes the timing belt 56 to run, moving the carriage 51 and the recording head 41 in the scanning direction.

The controller 5 controls the recording head 41 based on a recording command to jet each of the inks from each jetting port 41*a*. Namely, an image is recorded on the sheet P conveyed on the platen 6 by jetting each of the inks from each jetting port 41*a* while causing the recording head 41 to scan the sheet P during the reciprocating movement of the carriage 51 in the left-right direction A3. The printer unit 10 includes a linear encoder (not depicted) having many light transmissive parts (slits) that are aligned in the scanning direction at intervals. The carriage 51 includes a transmission-type position detection sensor (not depicted) having a light emitting element and a light receiving element. The printer unit 10 recognizes a current position of the carriage 51 in the scanning direction based on a count value of each transmissive part of the linear encoder detected by the position detection sensor during the movement of the carriage 51, controlling the rotational drive of the carriage motor 50M.

Figure 4:
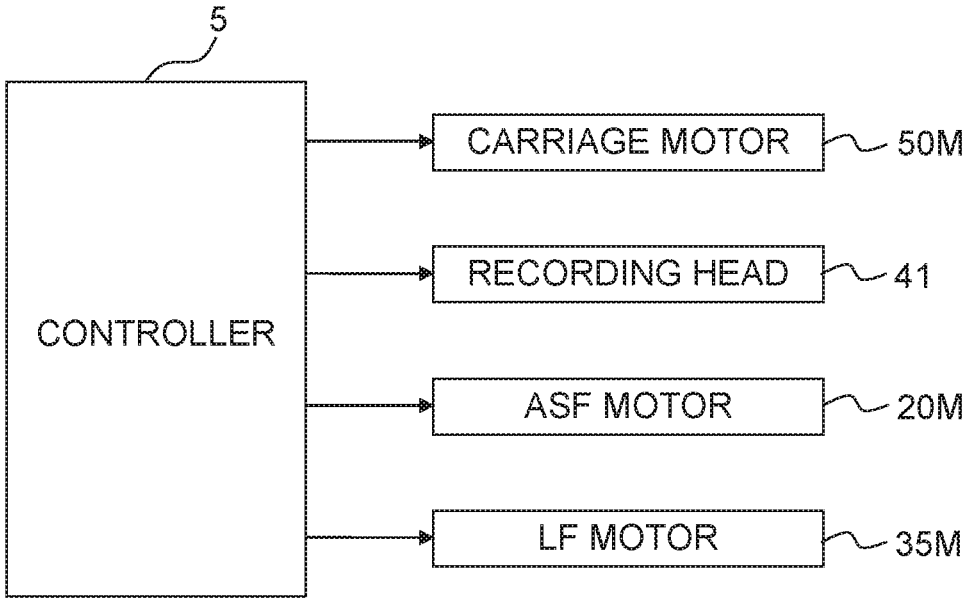
FIG. 4 is a block diagram of a controller.

As depicted in FIG. 4, the controller 5 includes a Central Processing Unit (CPU), a Read Only Memory (ROM), a Random Access Memory (RAM), an Application Specific Integrated Circuit (ASIC), and the like. Those corporate to control operations of the ASF motor 20M, the LF motor 35M, the carriage motor 50M, the recording head 41, and the like. For example, the controller 5 controls the recording head 41, the ASF motor 20M, the LF motor 35M, the carriage motor 50M, and the like based on a recording command transmitted from the scanner unit or the PC to record an image or the like on the sheet P.

In this embodiment, the controller 5 includes the single CPU and the single ASIC. The controller 5, however, may only include the single ASIC that collectively executes pieces of necessary processing. Or, the controller 5 may include multiple ASICs that execute the pieces of necessary processing in a shared manner.

Figure 6:
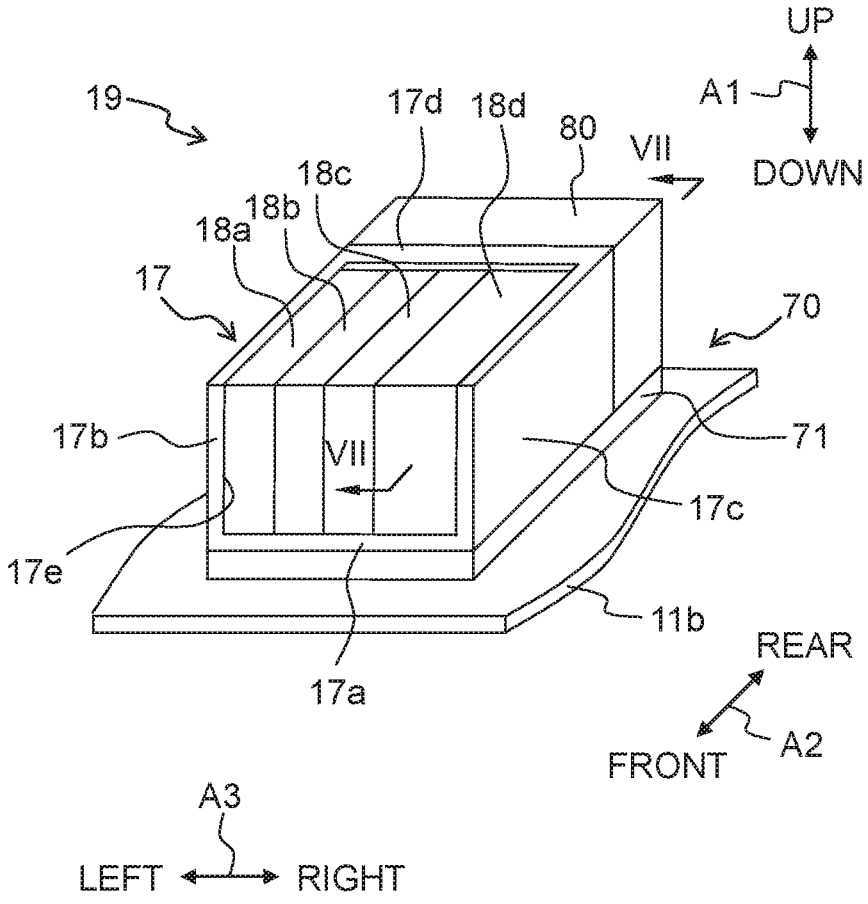
FIG. 6 is a schematic perspective view of an ink unit depicted in FIG. 3.

Subsequently, referring to FIGS. 5A to 8, the ink unit 19 is explained below. As depicted in FIGS. 5A, 5B, and 6, the ink unit 19 includes a first ink absorbing member 70 and a second ink absorbing member 80 in addition to the holder 17 and the four ink cartridges 18*a* to 18*d*. The four ink cartridges 18*a* to 18*d* are removably installed in the holder 17. The ink cartridge 18*d* disposed on the rightmost side has a width in the left-right direction A3 larger than those of the remaining three ink cartridges 18*a* to 18*c*, making the ink capacity of the ink cartridge 18*d* largest. The ink cartridge 18*d* contains the black ink. The three ink cartridges 18*a* to 18*c* respectively contain the yellow, cyan, and magenta inks. The three ink cartridges 18*a* to 18*c* have the same shape and the same ink capacity.

As depicted in FIG. 6, the holder (case) 17 has a bottom 17*a* supporting the four ink cartridges 18*a* to 18*d* from below and three side portions 17*b* to 17*d* facing side surfaces of the ink cartridges 18*a* to 18*d*. The bottom 17*a* is made using a plate-like member that has substantially a rectangular planar shape. The three side portions 17*b* to 17*d* are also made using plate-like members. The side portion 17*b* stands upright from a left end of the bottom 17*a*, the side portion 17*c* stands upright from a right end of the bottom 17*a*, and the side portion 17*d* stands upright from a rear end of the bottom 17*a*. This makes the holder 17 a box-shape that is open upward and frontward. The four ink cartridges 18*a* to 18*d* are installed by inserting them rearward from an installation opening (entrance) 17*e* provided on a front side of the holder 17. Namely, the holder 17 is configured to accommodate the four ink cartridges 18*a* to 18*d*.

The side portion 17*d* farthest in the front-rear direction A2 from the installation opening 17*e* of the holder 17 includes four ink introduction needles 17*d*1. FIG. 5B depicts three ink introduction needles 17*d*1 of the four ink introduction needles 17*d*1. The four ink introduction needles 17*d*1 (liquid introduction parts) are arranged in the left-right direction A3. Each of the ink introduction needles 17*d*1 of the side portion 17*d* is positioned to face, in the front-rear direction A2, a lower portion of the corresponding one of the ink cartridges 18*a* to 18*d* installed. Each of the ink introduction needles 17*d*1 is made using a hollow tube that extends in the front-rear direction A2. A rear end of each of the ink introduction needles 17*d*1 communicates with an ink channel (not depicted) in the side portion 17*d*. The ink channel communicates with the recording head 41 via each of the four tubes (not depicted) and the tube joint 44, as described above.

Figure 7:
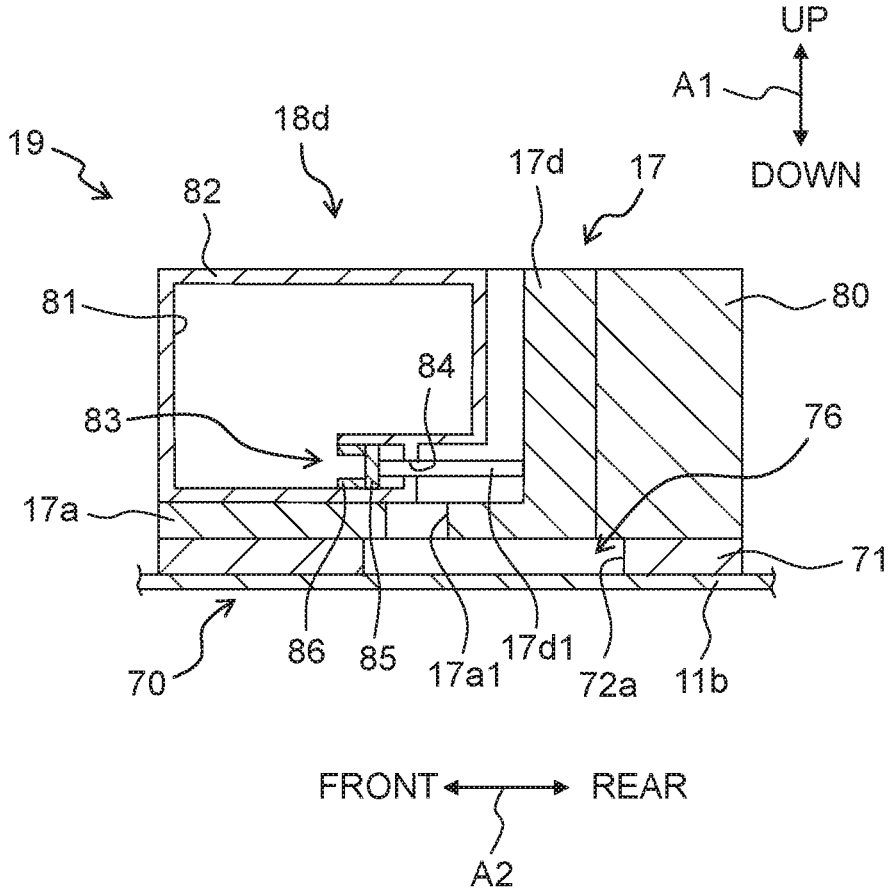
FIG. 7 is a cross-sectional view of the ink unit taken along a line VII-VII in FIG. 6.

Although the three ink cartridges 18*a* to 18*c* are different in ink capacity from the ink cartridge 18*d*, the three ink cartridges 18*a* to 18*c* and the ink cartridge 18*d* have substantially the same structure. Explanation is thus made only on the structure of the ink cartridge 18*d* and explanation about the structures of the three ink cartridges 18*a* to 18*c* are omitted. As depicted in FIG. 7, the ink cartridge 18*d* includes a main body 82 in which an ink chamber 81 containing the ink is formed. An ink discharge part 83 is formed at a position, of a lower end of the main body 82, facing the ink introduction needle 17*d*1 in the front-rear direction A2.

The ink discharge part 83, through which the ink in the ink chamber 81 is discharged, includes an opening 84 that is formed in the main body 82 and is open in the front-rear direction A2, a valve 85 configured to close the opening 84, and an urging member 86 urging the valve 85 toward the opening 84. As depicted in FIG. 7, installing the ink cartridge 18*d* in the holder 17 inserts a front end of the ink introduction needle 17*d*1 into the opening 84, moving the valve 85 frontward against the urging force of the urging member 86. Accordingly, the ink introduction needle 17*d*1 is inserted into the ink discharge part 83 to cause the ink introduction needle 17*d*1 to communicate with the ink discharge part 83, allowing the ink in the ink chamber 81 to be supplied to the recording head 41. Namely, also in each of the three ink cartridges 18*a* to 18*c*, installing each of them in the holder 17 causes the ink introduction needle 17*d*1 to communicate with the ink discharge part 83, supplying the ink in each of the ink cartridges 18*a* to 18*c* to the recording head 41. The ink discharge part 83 is not limited to the above configuration, provided that the ink in each of the ink cartridges 18*a* to 18*d* can be discharged from the ink discharge part 83. The ink introduction needle 17*d*1 is not limited to the above configuration, provided that the ink introduction needle 17*d*1 can communicate with the ink discharge part 83 when each of the ink cartridges 18*a* to 18*d* is installed in the holder 17.

The bottom 17*a* of the holder 17 has four through holes 17*a*1 passing therethrough in the up-down direction A1. FIG. 5B depicts three through holes 17*a*1 of the four through holes 17*a*1. The four through holes 17*a*1 are arranged in the left-right direction A3. As depicted in FIG. 7, each of the through holes 17*a*1 is provided in the bottom 17*a* at a position facing, in the up-down direction A1, a connection portion between the ink introduction needle 17*d*1 and the ink discharge part 83 of each of the installed ink cartridges 18*a* to 18*d*. In that configuration, when the ink in each of the ink cartridges 18*a* to 18*d* leaks from the connection portion between the ink introduction needle 17*d*1 and the ink discharge part 83 for some reason such as aged-related deterioration, the leaking ink flows downward through the through hole 17*a* and is absorbed by the first ink absorbing member 70.

Figure 8:
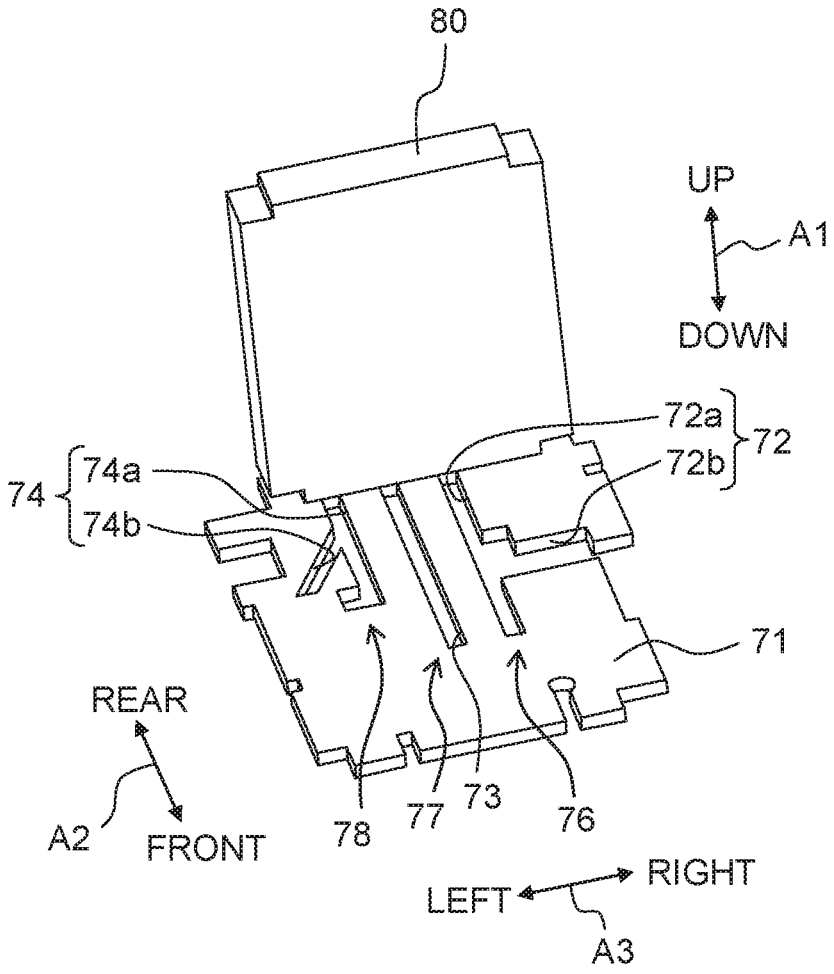
FIG. 8 is a perspective view of first and second ink absorbing members depicted in FIG. 6.

The first ink absorbing member 70 is formed from an absorbing foam 71 made using a soft porous material and a bottom 11*b* of the casing 11 that supports the absorbing foam 71 from below. The bottom 11*b* is made using a synthetic resin. The ink absorption ratio of the bottom 11*b* is lower than that of the absorbing foam 71 under a non-pressurization state. Here, the absorption ratio g/g represents an ink absorption amount (g) of an absorber (the absorbing foam in this embodiment) per one gram. As depicted in FIG. 8, the absorbing foam 71 has a flat-plate shape. The absorbing foam 71 has three through portions 72 to 74 passing through the absorbing foam 71 in its thickness direction (up-down direction A1). The through portions 72 to 74 are covered with the bottom 11*b* from below. This allows the first ink absorbing member 70 to have three grooves 76 to 78 defined by inner surfaces of the through portions 72 to 74 and an upper surface (front surface) of the bottom 11*b*.

The through portion 72 includes a first portion (through portion) 72*a* extending in the front-rear direction A2 and a second portion 72*b* extending rightward from a midway portion in the front-rear direction A2 of the first portion 72*a*. As depicted in FIG. 7, the first portion 72*a* extends in the front-rear direction A2 to face the through hole 17*a*1 (the through hole facing the connection portion between the ink discharge part 83 of the ink cartridge 18*d* and the ink introduction needle 17*d*1) in the up-down direction A1. Namely, in the first portion 72*a* of the groove 76, a portion between its front end and its rear end (i.e., a midway portion of the first portion 72*a* extending to the second ink absorbing member 80) faces the through hole 17*a*1. As depicted in FIG. 7, the rear end of the through portion 72 is provided at a position facing the second ink absorbing member 80 in the up-down direction A1. Namely, the first portion 72*a* of the groove 76 reaches the second ink absorbing member 80. In that configuration, when the ink leaks from the connection portion between the ink discharge part 83 of the ink cartridge 18*d* and the ink introduction needle 17*d*1, the leaking ink is capable of being guided to the second ink absorbing member 80 through the first portion 72*a* of the groove 76.

When the absorbing foam 71 is saturated with the ink(s) absorbed, the ink in the vicinity of the second portion 72*b* of the groove 76 leaks into the second portion 72*b*. The leaking ink flows to the first portion 72*a*, and the first portion 72*a* of the groove 76 guides that ink to the second ink absorbing member 80.

As depicted in FIG. 8, the through portion 73 extends parallel to the first portion 72*a*. The through portion 73, which extends in the front-rear direction A2, faces in the up-down direction A1 the through hole 17*a*1 (the through hole facing the connection portion between the ink discharge part 83 of the ink cartridge 18*c* and the ink introduction needle 17*d*1). In the groove 77, a portion between its front end and its rear end (i.e., a midway portion of the groove 77 extending to the second ink absorbing member 80) faces the through hole 17*a*1. As depicted in FIG. 8, the through portion 73 is positioned so that its rear end faces the second ink absorbing member 80 in the up-down direction A1. Similar to the first portion 72*a* of the groove 76, the groove 77 reaches the second ink absorbing member 80. In that configuration, when the ink leaks from the connection portion between the ink discharge part 83 of the ink cartridge 18*c* and the ink introduction needle 17*d*1, the groove 77 guides the leaking ink to the second ink absorbing member 80.

The through portion 74 includes a first portion (through portion) 74*a* extending in the front-rear direction A2 and a second portion (through portion) 74*b* extending toward a left obliquely forward side from a midway portion in the front-rear direction A2 of the first portion 74*a*. The first portion 74*a* extends rearward from a position facing the through hole 17*a*1 (the through hole facing the connection portion between the discharge part 83 of the ink cartridge 18*b* and the ink introduction needle 17*d*1) in the up-down direction A1. Namely, a front end of the first portion 74*a* of the groove 78 faces the through hole 17*a*1. As depicted in FIG. 8, a rear end of the through hole 74 is disposed at a position facing the second ink absorbing member 80 in the up-down direction A1. Namely, the first portion 74*a* of the groove 78 reaches the second ink absorbing member 80. In that configuration, when the ink leaks from the connection portion between the ink discharge part 83 of the ink cartridge 18*b* and the ink introduction needle 17*d*1, the first portion 74*a* of the groove 80 guides the leaking ink to the second ink absorbing member 80.

The second portion 74*b* extends toward a right oblique rear side from a position facing the through hole 17*a*1 (the through hole facing the connection portion between the ink discharge part 83 of the ink cartridge 18*a* and the ink introduction needle 17*d*1) in the up-down direction A1. A front end of the second portion 74*b* of the groove 78 faces the through hole 17*a*1. In that configuration, when the ink leaks from the connection portion between the ink discharge part 83 of the ink cartridge 18*a* and the ink introduction needle 17*d*1, the second portion 74*b* and a part of the first portion 74*a* of the groove 78 guides the leaking ink to the second ink absorbing member 80.

As depicted in FIGS. 7 and 8, the second ink absorbing member 80 has a flat-plate shape in which its thickness in the front-rear direction A2 is thicker than the thickness of the absorbing foam 71 in the up-down direction A1. Similar to the absorbing foam 71, the second ink absorbing member 80 is made using a soft porous material. The ink absorption ratio of the second ink absorbing member 80 is higher than that of the absorbing foam 71 under the above non-pressurization state. The second ink absorbing member 80 is larger in volume than the absorbing foam 71 of the first ink absorbing member 70. Thus, an amount of ink that can be absorbed and retained in the second ink absorbing member 80 is larger than that of the first ink absorbing member 70. As depicted in FIG. 7, the second ink absorbing member 80 is disposed to extend along a rear surface of the side portion 17*d* while being brought contact with a rear end of the absorbing foam 71. In that configuration, the ink guided to the second ink absorbing member 80 by the first ink absorbing member 70 is absorbed by the second ink absorbing member 80 through the rear end of the first ink absorbing member 70, and retained in the second ink absorbing member 80.

As described above, in the printer unit 10 of this embodiment, for example, when a large amount of ink leaks from the connection portion between the ink introduction needle 17*d*1 and the ink discharge part 83 of each of the ink cartridges 18*a* to 18*d* for some reason, such as aged-related deterioration, and flows down beyond the holder 17, the ink is absorbed by the first ink absorbing member 70 disposed below the holder 17. Most of the ink flowing down beyond the holder 17 through the through hole 17*a*1 is guided to the second ink absorbing member 80 by each of the grooves 76 to 78 formed in the first ink absorbing member 70 and extending to the second ink absorbing member 80. In that configuration, the ink is effectively absorbed not only by the first ink absorbing member 70 but also by the second ink absorbing member 80 having high absorption ability, preventing the ink from leaking to the outside of the multifunction peripheral 1. The ink, that does not flow into each of the grooves 76 to 78 through the through hole 17*a*1 but flows down along the holder 17 and then absorbed by the first ink absorbing member 70, leaks into each of the grooves 76 to 78 when the first ink absorbing member 70 is saturated with the ink(s), and the ink is guided to the second ink absorbing member 80. Accordingly, the ink is effectively absorbed not only by the first ink absorbing member 70 but also by the second ink absorbing member 80 having high absorption ability.

The second ink absorbing member 80 is disposed to extend along the side portion 17*d* of the holder 17. Disposing the second ink absorbing member 80 by using a space on a rear side of the side part 17*d* of the holder 17 eliminates the space used only for placement of the second ink absorbing member 80. This downsizes the printer unit 10.

The rear ends of the three grooves 76 to 78 in the first ink absorbing member 70 reach the second ink absorbing member 80, making it easier for the inks guided by the grooves 76 to 78 to be absorbed by the second ink absorbing member 80.

Forming a groove that does not pass through the absorbing foam 71 absorbing the ink may make the production process complicated and may increase manpower. In this embodiment, however, the grooves 76 to 78 are easily formed in the first ink absorbing member 70 by forming the through portions 72 to 74 in the absorbing foam 71 and covering and closing the through portions 72 to 74 with the bottom 11*b* of the casing 11 from below.

The four through holes 17*a*1 are formed in the bottom 17*a* of the holder 17 at positions facing, in the up-down direction A1, the connection portions between the ink discharge parts 83 of the installed ink cartridges 18*a* to 18*d* and the ink introduction needles 17*d*1. Forming the through holes 17*a*1 at positions facing the connection portions between the ink discharge parts 83 and the ink introduction needles 17*d*1, the connection portions being positions where the inks are likely to leak from the ink cartridges 18*d* to 18*d*, allows the inks leaking from the ink cartridges 18*a* to 18*d* to be guided to the first ink absorbing member 70. Since the grooves 76 to 78 of the first ink absorbing member 70 face the through holes 17*a*1 in the up-down direction A1, the inks can be effectively guided to and absorbed by the second ink absorbing member 80 through the grooves 76 to 78. This configuration prevents the inks in the ink cartridges 18*a* to 18*d* from flowing along the holder 17 and leaking to the outside of the multifunction peripheral 1.

The through hole 17*a*1 formed in the bottom 17*a* of the holder 17 faces, in the up-down direction A1, the connection portion between the ink discharge part 83 of the largest ink cartridge 18*d* and the ink introduction needle 17*d*1. In that configuration, when the ink leaks from the largest ink cartridge 18*d*, the leaking ink can be effectively absorbed by the first ink absorbing member 70 and the second ink absorbing member 80.

The four through holes 17*a*1 face the three grooves 76 to 78 in the up-down direction A1. In that configuration, when the ink leaks from each of the ink cartridges 18*a* to 18*d*, the leaking ink can be effectively absorbed by the first ink absorbing member 70 and the second ink absorbing member 80.

The second ink absorbing member 80 is disposed on the rear side of the side portion 17*d* that is positioned innermost of the holder 17 in the installation direction of the ink cartridges 18*a* to 18*d* (rear direction). In that configuration, the second ink absorbing member 80 is disposed at a position separated from the installation opening 17*e* of the holder 17 through which the ink cartridges 18*a* to 18*d* are installed. This prevents the inks from leaking to the outside of the multifunction peripheral 1 when the second ink absorbing member 80 is saturated with the inks.

Figure 9:
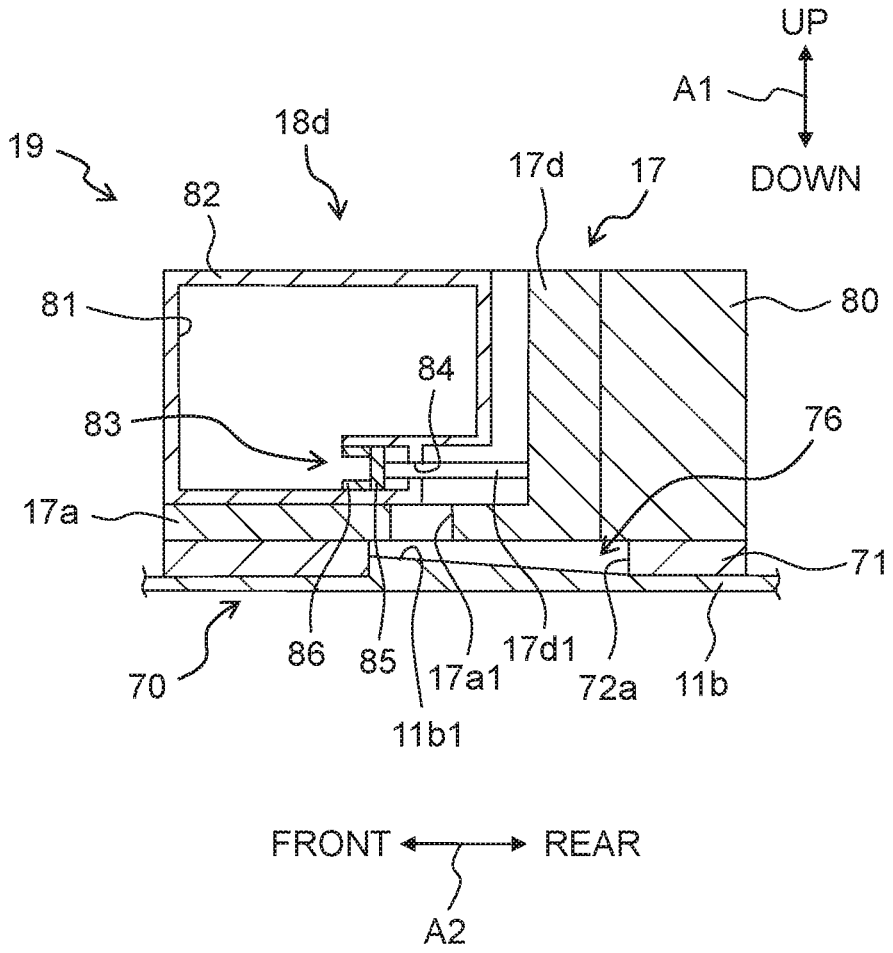
FIG. 9 is a cross-sectional view of a main part of a modified example of the first ink absorbing member depicted in FIG. 7.

In the above embodiment, the bottom surface of the groove 76 (i.e., the upper surface of the bottom 11*b*) is a horizontal surface. The bottom surface of the groove 76, however, may be an inclined surface 11*b*1, as depicted in FIG. 9. In this modified example, the inclined surface 11*b*1 may be formed in an area facing the first portion 72*a* of the through portion 72 of the bottom 11*b*. The inclined surface 11*b*1 is inclined downward toward the second ink absorbing member 80. This allows the ink leaking from the ink cartridge 18*d* to be easily guided to the second ink absorbing member 80. The ink is thus absorbed by the second ink absorbing member 80 further effectively.

As another modified example, four ink tanks that can not be removed from the holder 17 may be provided instead of the ink cartridges 18*d* to 18*d*. The ink tanks contain inks having mutually different colors. A front surface of each of the ink tanks has a supply port through which the ink tank is replenished with the ink. When each of the ink tanks contains no ink, a user opens the openable and closable cover 13 to supply the ink tank with the ink. When the ink leaks, for example, from the vicinity of the supply port at the time of the ink replenishment, the ink flowing down along the holder 17 is absorbed by the first ink absorbing member 70, like the above embodiment. When the ink tank is partially damaged and the ink leaks from the damaged part, the ink flowing down along the holder 17 is absorbed by the first ink absorbing member 70, like the above embodiment. In both cases, most of the ink flowing down beyond the holder 17 leaks into each of the grooves 76 to 78 when the first ink absorbing member 70 is saturated with the ink(s), and then the ink is guided to the second absorbing member 80, like the above embodiment. The modified examples thus can obtain the effects similar to the above embodiment. The ink flowing into each of the grooves 76 to 78 through the through hole 17*a*1 is also guided to the second ink absorbing member 80, as described above.

The preferred embodiments of the present teaching have been explained above. The present teaching, however, is not limited to these embodiments. Various changes may be made without departing from the claims. For example, the grooves 76 to 78 in the above embodiment may not face the through holes 17*a*1 in the up-down direction A1. Namely, a groove extending from a predefined position of the first ink absorbing member 70 (absorbing foam 71) to the second ink absorbing member 80 may be formed. The ink absorbed by the first ink absorbing member 70 leaks into the groove when the first ink absorbing member 70 is saturated with the ink. The leaking ink is guided to the second absorbing member 80 through the groove. This configuration thus can obtain the effects similar to the above embodiment. The groove may not reach the second ink absorbing member 80. The first ink absorbing member 70 may be made only using the absorbing foam. In the above embodiment, although the first portion 72*a* and the through portions 73 and 74 are the through holes formed in the absorbing foam 71, they may be notches.

The through holes 17*a*1 may not be formed in the bottom 17*a* of the holder 17. In that configuration, the ink flowing down along the bottom 17*a* of the holder 17 is absorbed by the first ink absorbing member 70 and then guided to the second ink absorbing member 80 through each of the grooves 76 to 78, as described above. That configuration thus can obtain the effects similar to the above embodiment.

The ink cartridges 18*a* to 18*d* (liquid tanks) may have the same liquid capacity, the same shape, and the same size. The ink cartridges 18*a* to 18*d* (liquid tanks) may have mutually different liquid capacities, mutually different shapes, and mutually different sizes. The grooves 76 to 78 are not limited to the three grooves, and may be one groove, two grooves, or equal to or more than four grooves.

The second ink absorbing member 80 may be disposed outside the holder 17 to extend along at least any of the two side portions 17*b* and 17*c*, except for the side portion 17*d*.

In the above description, the explanation has been made on the example in which the present teaching is applied to the printer unit that performs recording by jetting ink from each jetting port 41*a*. The present teaching, however, is not limited thereto. The present teaching can be applied to any other liquid jetting apparatus than the printer unit. Such a liquid jetting apparatus jets a liquid other than the ink from each jetting port 41*a*. The present teaching can be applied to both a printer of a line type and a printer of a serial type.

What is claimed is:

1. A liquid jetting apparatus, comprising:

a case including a bottom which supports, from below, a liquid tank containing liquid, and side parts which stand upright from the bottom and face side surfaces of the liquid tank, a first absorbing member disposed outside the case to extend along the bottom of the case and configured to absorb the liquid; and a second absorbing member disposed outside the case to extend along one of the side parts of the case while being brought into contact with the first absorbing member, and having an absorption ratio of the liquid which is higher than that of the first absorbing member under a non-pressurization state, wherein the first absorbing member includes a groove which extends to the second absorbing member to guide the liquid leaking downward from the liquid tank to the second absorbing member.

2. The liquid jetting apparatus according to claim 1, wherein the groove reaches the second absorbing member.

3. The liquid jetting apparatus according to claim 1, wherein the first absorbing member includes an absorbing foam having a through portion which passes through the absorbing foam in a vertical direction, and a covering member covering and closing the through portion from below and having an absorption ratio of the liquid which is lower than that of the absorbing foam, and the groove is defined by an inner surface of the through portion and a surface of the covering member.

4. The liquid jetting apparatus according to claim 1, wherein the case includes a liquid introduction part, the liquid introduction part is connected to and communicates with a liquid discharge part by accommodating the liquid tank in the case, the liquid discharge part being configured to discharge the liquid in the liquid tank, the bottom has a hole at a position facing, in a vertical direction, a connection portion between the liquid discharge part and the liquid introduction part, and the groove faces the hole in the vertical direction.

5. The liquid jetting apparatus according to claim 4, wherein the case accommodates liquid tanks including the liquid tank, the case includes liquid introduction parts including the liquid introduction part and corresponding respectively to the liquid tanks, and the hole faces, in the vertical direction, a connection portion between the liquid discharge part of one of the liquid tanks having a largest capacity and the liquid introduction part corresponding to the one of the liquid tanks having the largest capacity.

6. The liquid jetting apparatus according to claim 5, wherein the liquid tanks include liquid discharge parts including the liquid discharge part, the bottom includes holes including the hole and respectively facing connection portions between the liquid discharge parts of the liquid tanks and the liquid introduction parts, and the first absorbing member includes grooves including the groove and respectively facing the holes in the vertical direction.

7. The liquid jetting apparatus according to claim 1, wherein the case is configured so that the liquid tank is removable with respect to the case, the side parts of the case face the liquid tank in an installation direction of the liquid tank in which the liquid tank is installed in the case, and the second absorbing member is disposed to extend along one of the side parts of the case.

8. The liquid jetting apparatus according to claim 1, wherein a bottom surface of the groove is inclined downward toward the second absorbing member.

* * * * *